United States Patent [19]

Shamash

[11] Patent Number: 4,612,744

[45] Date of Patent: Sep. 23, 1986

[54] METHOD, COMPONENTS, AND SYSTEM FOR ASSEMBLING BUILDINGS

[76] Inventor: Jack E. Shamash, 1172 Park Ave., New York, N.Y. 10028

[21] Appl. No.: 604,819

[22] Filed: Apr. 27, 1984

Related U.S. Application Data

[63] Continuation-in-part of Ser. No. 290,855, Aug. 7, 1981, abandoned.

[51] Int. Cl.[4] ..... E04B 5/48; E04F 17/06

[52] U.S. Cl. ..... 52/220; 52/372; 52/376; 52/300; 52/738; 52/239; 52/243.1

[58] Field of Search ..... 52/664–669, 52/238.1, 239, 241, 243.1, 730–732, 281, 282, 601, 349, 481, 275, 344, 376, 368, 300, 738, 220, 221, 372

[56] References Cited

U.S. PATENT DOCUMENTS

| | | | |
|---|---|---|---|
| 1,134,736 | 4/1915 | Gleason | 52/349 |
| 1,169,016 | 1/1916 | Duarte . | |
| 1,343,926 | 6/1920 | Madsen . | |
| 1,370,686 | 3/1921 | Dodson | 52/281 |
| 1,446,916 | 2/1923 | McElheny | 52/349 |
| 1,707,858 | 4/1929 | Hurlbert . | |
| 1,983,020 | 12/1934 | De Vol | 52/601 |
| 2,079,635 | 5/1937 | Sharp . | |
| 2,388,297 | 11/1945 | Slaughter . | |
| 2,934,180 | 4/1960 | Hammitt et al. | 52/732 |
| 3,423,891 | 1/1969 | Burris . | |
| 3,712,015 | 6/1973 | Nelson | 52/481 |
| 3,821,868 | 7/1974 | Edwards . | |

FOREIGN PATENT DOCUMENTS

| | | | |
|---|---|---|---|
| 403620 | 6/1968 | Australia | 52/92 |
| 746830 | 6/1933 | France . | |
| 1171513 | 10/1958 | France | 52/601 |
| 500941 | 11/1954 | Italy . | |
| 368919 | 6/1963 | Switzerland | 52/241 |
| 153973 | 11/1920 | United Kingdom | 52/344 |
| 507987 | 6/1939 | United Kingdom . | |
| 670797 | 4/1952 | United Kingdom | 52/275 |

OTHER PUBLICATIONS

Undated flyer, "Shapes of the Future", author Creative Pultrusions, Inc.

*Primary Examiner*—James L. Ridgill, Jr.
*Attorney, Agent, or Firm*—Brumbaugh, Graves, Donohue & Raymond

[57] ABSTRACT

Structural members for building systems include plastic base members having side flanges connected by a central web. For use at floor level at the perimeter of the building, a base member includes a series of openings spaced longitudinally along one flange to receive tubular members that span the building interior. Base members for use inwardly of the building perimeter include aligned openings in both flanges to permit the tubular members to extend through. Upright members also include side flanges and a central connecting web. Further inner flanges integral with the connecting web are spaced slightly from the side flanges and define slots running along the length of the member to receive edges of panels forming opposite surfaces of a wall. The inner flanges are shorter in length than the side flanges so that the upper ends of the upright members can receive a spanning element that runs from one upright member to the next. Likewise, the inner flanges are slightly shorter than the side flanges, measured from the web. This permits insertion of a closing member, typically a plank of standard lumber dimensions, where the upright members are used to frame a doorway or other opening. The base members can also include inner flanges. These can have aligned openings for the tubular members. Tubular members can be PVC pipe and can accommodate the building services. For poured concrete flooring, a wire mesh or the like woven over and under the tubular members at ground level decreases the amount of poured concrete necessary.

16 Claims, 20 Drawing Figures

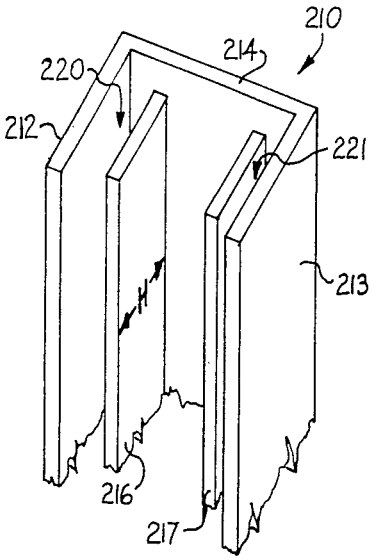
FIG. 11
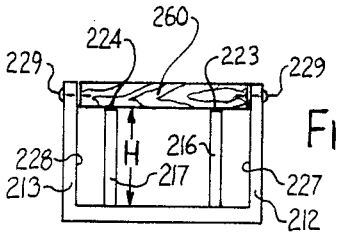
FIG. 14
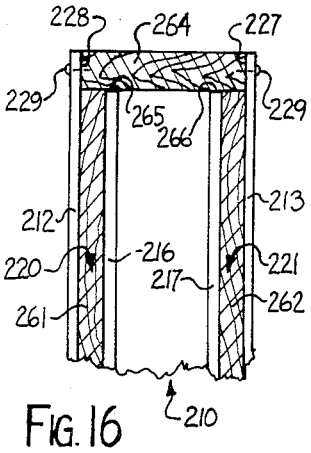
FIG. 16
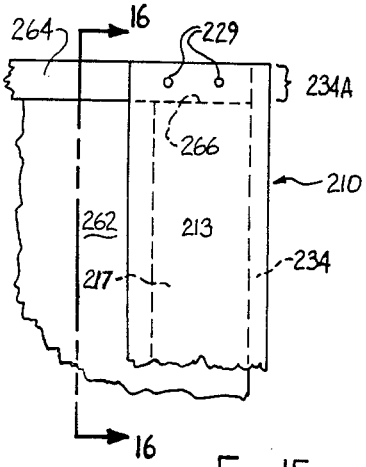
FIG. 15
FIG. 12
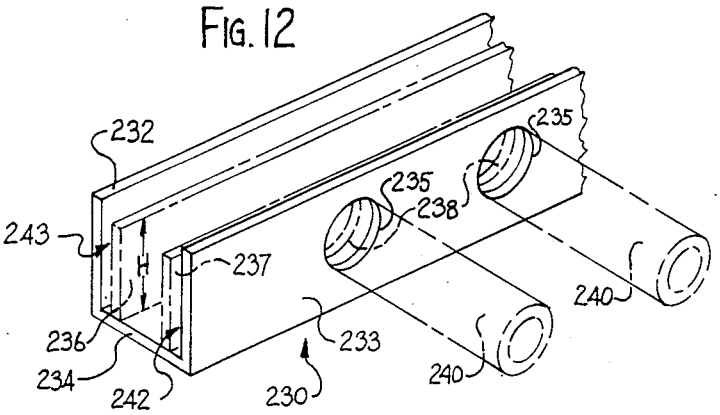
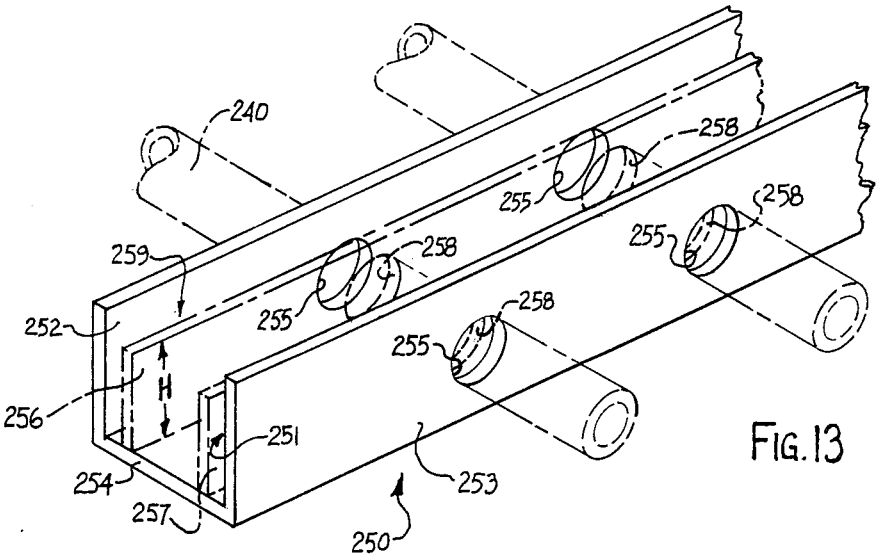
FIG. 13

METHOD, COMPONENTS, AND SYSTEM FOR ASSEMBLING BUILDINGS

REFERENCE TO RELATED APPLICATIONS

This is a continuation-in-part of U.S. patent application Ser. No. 290,855, filed Aug. 7, 1981 now abandoned.

BACKGROUND OF THE INVENTION

This invention relates to methods, components and a system of structural members for buildings, and more particularly, to structural members which both support a building and connect the walls thereof.

An important consideration in the construction of any building is cost. One means of controlling the costs of constructing a building is to use modular structural components in its construction. These components may be fabricated into modular subassemblies for later construction at the site.

In many underdeveloped countries, a severe housing shortage exists. A means of constructing simple dwellings can contribute in reducing the poverty in these countries. However, the paucity of skilled labor makes it difficult to produce suitable dwellings on a large scale. The least developed countries have a surplus of unskilled labor, which, if tapped, could be used to help alleviate the housing problem. One means of tapping this source of unskilled labor is to provide dwelling homes made of simple, modular constructions which can be assembled with the unskilled labor.

Dwellings such as summer homes or cottages are generally of secondary importance and may not be used throughout the year. These, too, may be built with little or no skilled labor as, e.g., on small or underdeveloped islands. A method of keeping the cost of construction of such dwellings to a minimum will decrease the selling price and correspondingly increase the number of dwellings sold.

Prior art systems have not fully addressed the problems posed above. Some suggested constructions have used parts that were complicated to manufacture and difficult to assemble. In many prior art systems of building construction, expensive materials are used throughout. Even if these systems were easily assembled (not always the case), the initial cost could be prohibitive. Corrugated panels have been used to construct dwellings, but these tend to result in unsightly shanty towns. One system has used clamps to join corrugated walls to form dwellings, with facing panels to hide the corrugations. In another prior system, an "I" shaped member is used to position parallel metal sheets in a floor, which is then covered with a suitable plastic coating and wood. However, this system requires expensive prefabricated metal components, and is not well suited to constructing a wall. Thin walled tubes of, for example, cardboard, have been suggested for the construction of poured concrete forms. However, galvanized top and bottom frames with sheet metal top and bottom retainers or moldings are employed to hold wall panels in place, and these add expense and complication to this suggested structure. The tubular members are filled with concrete for strengthening. In another suggested arrangement, tubular members are stood side by side to form walls that are then covered with a cementitious layer. This suggestion presumes the labor necessary to form the cement layer, a cement foundation, and an intermediate cement beamlike portion between upper and lower wall sections is available. This construction method requires more than just unskilled labor and would appear to be expensive and slow.

Accordingly, a need thus exists for inexpensive buildings which do not require substantial amounts of skilled labor, but which can be made reasonably attractive and can be readily and quickly assembled.

SUMMARY OF THE INVENTION

The system of the present invention, in combination with interior and exterior wall panels, can be used to construct simple buildings. The system uses modular components, preferably made of extruded or formed plastic or fiberglass. As used herein "plastic" includes materials typically called fiberglass and, for example, fiberglass reinforced resinous material such as that currently used in the known Pultrusion process, as well as the wide variety of thermoplastic materials capable of extrusion or otherwise forming into members of sufficient strength and durability for the purposes described. The components include structural members that can serve as single beams or uprights for supporting a wall, double beams for connecting several wall panels to form a long wall, angle beams for joining perpendicular wall panels to form a corner, T beams for abutting one wall with another wall, and cross beams for joining four mutually perpendicular walls.

The modular components of the present invention are made of extruded or formed plastic, and have flanges with slots formed to accept the wall panels. Pairs of flanges extend from a central support tube, with one flange accepting an interior wall panel and the other flanges accepting an exterior wall panel, for example. The tubular component of the present invention may be filled with concrete or other material for strength.

A method of constructing a simple building comprises the steps of fabricating the plurality of modular components, providing a foundation for the building, positioning the wall panels at the construction site, joining the wall panels with the modular structural members to form the walls of the building, and filling the structural members with, say, concrete for strength.

In a further embodiment, standardized extruded or formed plastic structural elements include a base member or beam having side flanges extending along a central web and cooperating with panels forming opposite surfaces of a wall. A series of openings in the side flanges receives elongate tubular members at floor level spanning the interior of a building. Exterior base members of this kind have the series of openings in just the interiorly facing flange to receive ends of the tubular members. Intervening base members or beams to be located between exterior base members have aligned openings for passage of the tubular members entirely through the base member.

In this further embodiment, uprights are plastic members with side flanges and parallel inner flanges all connected by a central web. The inner flanges cooperate with the side flanges to define slots into which side edges of the panels are received. The inner flanges are preferably shorter in height, measured from the web. In this way, at openings such as doors, standard lumber size planks can be located between the side flanges at the ends of the inner flanges to finish the opening and mask the interior of the extruded members. The base members too can include the shorter inner flanges to receive lower panel edges between the side and inner flanges. At their upper ends, the additional inner flanges of the upright members can terminate short of the side flanges to accommodate spanning elements, which again may be standard lumber planks extending from one such upright to another atop the panels forming the walls.

Preferably, in a building constructed using the base and upright members just described, a mesh or web is woven over and under the horizontally extending tubular members and concrete is poured over the web to approximately the top of the base members. The web results in considerable savings of the amount of concrete used over that which would be used if the entire interior flooring of the building were poured full from the ground level to the top of the base members.

The use of the tubular members spanning the building interior at generally floor level results in a large savings in materials and labor. These may be plastic pipe commonly used as a building's sewage lines and widely available at modest cost. Other choices may be specially extruded tubes of greater strength of the above-mentioned Pultrusion material of fiberglass reinforced resin, the resin being a product of the General Electric Co. Likewise, for greater strength, where flooring is laid on and supported by the tubular members, galvanized or steel piping may be chosen. All of these are considerally cheaper than nailed together 2×4 wooden floor support structure now in widespread use. Such structure requires a great deal more labor in cutting and nailing of 2×4's as well as having high material costs. Plastic tubular members of 32′ or 36′ lengths serving the subflooring purpose of this invention and spaced 3′ center to center throughout a 32′ or 36′ long building of similar width employs the intervening cross beams every 8′ to 12′ along their length, and currently costs only on the order of $100, compared to many times that amount for a 2×4 structure as mentioned above. In addition only an insignificant amount of low skill labor is necessary to assemble the tubular members and base members or beams. Further savings and convenience are realized by employing the tubular members to direct therethrough heating fluid, hot air or water, for example, for heating purposes as well as by using selected tubular members for accommodating other of the buildings services such as electrical wiring, plumbing and the like.

Further savings are accomplished by prefabricating individual wall sections in lengths of 32′ to 36′ to fit standard 40′ length shipping containers. Individual base members or beams can be extruded to any length but preferably are 24′ to 36′ long. Again, on-site labor is greatly reduced. Slots in upright extruded plastic members are sized to fit, for example, standard 4′×8′ plywood sheets to form opposite surfaces of a wall. These panels may be purchased at the building site or shipped with the frame-like wall section or they may be preassembled with window and door units in place. When preassembled they can be temporarily located in place in the prefabricated wall section so as to be easily removed for any necessary access to wall interiors during construction.

Along perimeter base beams receiving the tubular member ends and along the intervening base beams, openings occur every 3′ to cooperate with the tubular members. The intervening beams support the tubular members at locations between their ends and connect to perimeter base beams running parallel to the tubular members. For connection purposes throughout the building commercially available bonding compositions, solvent type plastic bonding liquid for example, and standard fasteners such as screws, bolts and nails can be employed where needed.

Along with a poured concrete floor covering the elongate members and filling the intervening base members or beams, wall interiors may be partially or fully poured with concrete. Alternatively the interiors between panels may be filled with insulating material.

BRIEF DESCRIPTION OF THE DRAWINGS

A more complete understanding of the invention and its advantages will be apparent from the following Detailed Description taken in conjunction with the accompanying drawings in which:

FIG. 11 a fragmentary perspective view of a plastic member intended for use as an upright in accordance with a further embodiment of the invention;

FIG. 12 is a fragmentary perspective view of a plastic base member for location at exterior edges of a building and bearing a series of openings to receive elongate tubular members at floor level;

FIG. 13 is a further perspective fragmentary view of a base member with aligned openings in both side flanges for the passage of tubular members entirely therethrough;

FIG. 14 is an end view of an upright member with a plank between side flanges;

FIG. 15 is a fragmentary front elevation of the interfitting of a spanning element, panel, and extruded upright;

FIG. 16 is a fragmentary cross-sectional view along the line 16—16 of FIG. 15 and shows the relationship of the spanning element, the panels, and the slots between flanges of the extruded upright;

DETAILED DESCRIPTION

Figure 1:
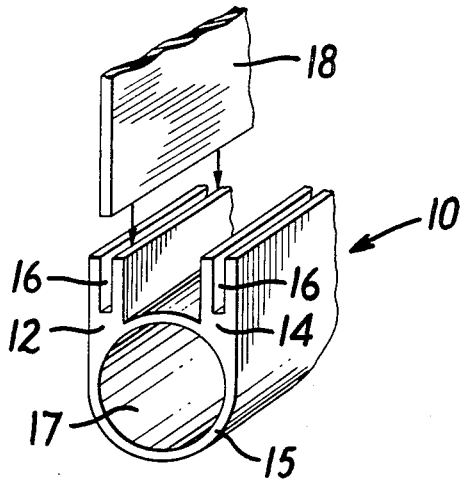
FIG. 1 is a fragmentary perspective view of a structural member according to the invention and having a central pipe-like portion supporting slotted flanges for retaining a pair of wall panels.

In FIG. 1, a structural member 10 has a pair of flanges 12, 14 each tangent to and extending from a tube 15. Because the structural member can be used to form a single wall, floor or ceiling section extending in one direction therefrom, the member 10 is referred to herein as a "single beam". The single beam 10 is extruded or formed along with the flanges 12, 14 by methods well-known to those of skill in the art. Suitable plastics for extrusion include polyvinyl chloride (PVC). Other plastics or fiberglass may be used with the present invention as will be evident to those of skill in the art.

The single beam 10 can be extruded to any length for use in the construction of a building. Naturally, standardized lengths of, 8 or 12 feet will be preferred for economic reasons, as well as ease of construction. Likewise, the dimensions of shipping containers are to be considered in selecting the dimensions for this or any other component of the system described herein.

The tube 15 defines a central axial opening 17 along the entire length of the beam. The flanges 12, 14 of the single beam 10 include slots or grooves 16 into which a suitable wall panel 18 fits. As will be described more fully hereinbelow, a panel 18 is inserted in each groove 16 to form a wall of a building.

Figure 2:
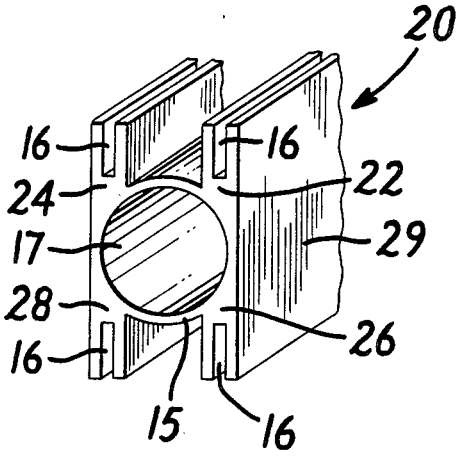
FIG. 2 is a fragmentary perspective view of a double structural member with slotted flanges to locate coplanar wall panels.

In FIG. 2, a further structural member 20 called herein a "double beam", includes a first pair of flanges 22, 24 and a second pair of flanges 26, 28. The first pair of flanges 22, 24 is positioned coplanar with the second pair of flanges 26, 28. Again all of the flanges are tangent a central tube 15. Like each of the beams described herein, the beam 20 can be extruded by the same process used to form the single beams 10. Substitution of one extrusion die for another determines the particular beam.

The flanges 22, 24, 26, 28 also have slots 16 formed therein for receiving the wall panels 18 (not shown in FIG. 2). The slots 16 are formed of a uniform depth to receive panels of standardized lengths. Each side of a double beam 20 has a face 29 which is formed by the coplanar outer surfaces of the flanges 22, 26 on one side, and the flanges 24, 28 on the other. As with other exposed surfaces in each of the beams according to the invention, suitable decoration may be extruded with the structural member 20, such as, for example, wood grain effects.

Figure 3:
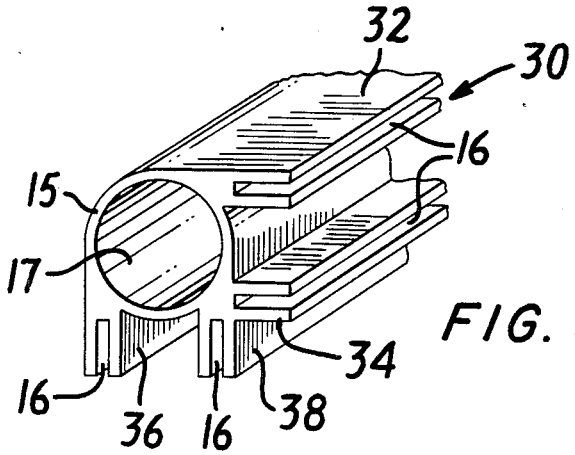
FIG. 3 is a fragmentary perspective view of a corner-forming member or angle beam with flanges extruded to locate wall panels at right angles.

The structural member of FIG. 3 is used to connect two perpendicular wall, ceiling or floor sections in a building. This structural member, or "angle beam" 30, includes a first pair of flanges 32, 34 and second pair of perpendicularly situated flanges 36, 38. The flanges 32–38 have slots 16 for receiving the wall panels. Such an angle beam 30 may be used, for example, as the outside corner of a building. In such a construction, exterior wall panels 18 fit in slots 16 of flanges 32, 36 to form the exterior walls of the building. Interior wall panels 18 then fit into slots 16 of flanges 34, 38 to form the interior walls of the building.

Figure 4:
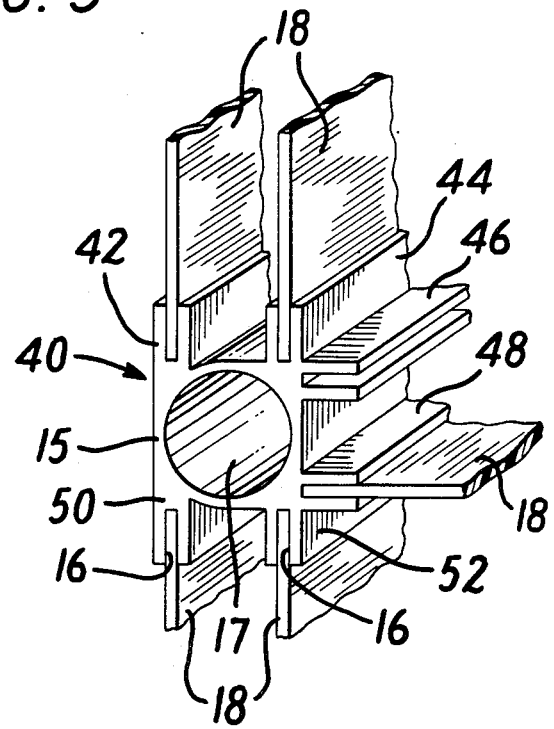
FIG. 4 is a fragmentary perspective view of a structural member for three adjoining walls, with wall panels inserted in the slots in the flanges.

The member of FIG. 4 is a "T beam" 40 used to abut wall sections coming together in a "T". The T beam has a first pair of flanges 42, 44, a second pair of flanges 46, 48, perpendicular to the first pair, and a third pair of flanges 50, 52 coplanar with the first pair. Again, each flange includes a slot 16 to receive wall panels 18, as shown. Each flange is tangent a central tube 15.

Figure 5:
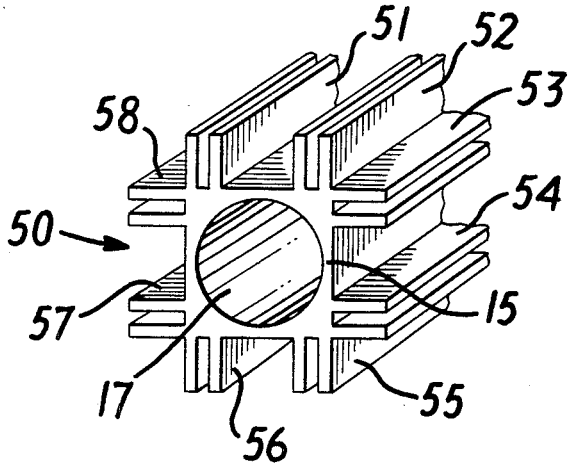
FIG. 5 is a fragmentary perspective view of a beam for joining four mutually perpendicular walls.

The structural member of FIG. 5 is a "cross beam" used to connect four mutually perpendicular walls. The cross beam 50 has four pairs of slotted flanges 51, 52, 53, 54, 55, 56, 57, and 58. The first pair of flanges 51, 52 is perpendicular to the second pair of flanges 53, 54. The third pair 55, 56 is perpendicular to the second pair 53, 54 and coplanar to the first. The fourth pair of flanges 57, 58 is perpendicular to the first and third pairs of flanges and coplanar to the second pair. As in the previously described structural members, the slots 16 are formed of a uniform depth to facilitate the installation of wall panels.

Figure 6:
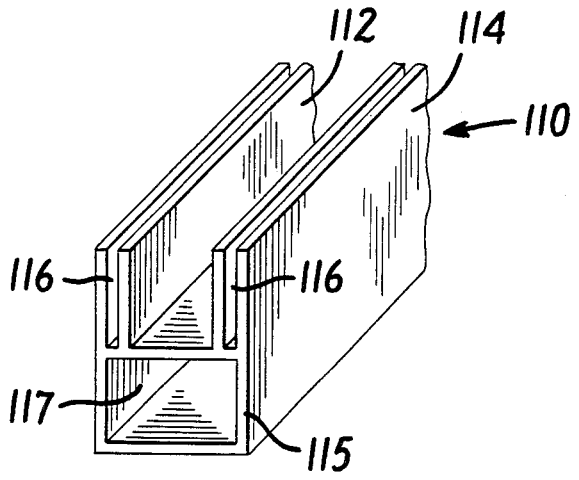
FIG. 6 is a fragmentary perspective view of an alternate embodiment of the present invention in which the central portion has a rectangular cross-section.

In FIG. 6, a single beam 110 of an alternate embodiment of the present invention is illustrated. In this embodiment, a tubular portion 115 of the single beam 110 has a rectangular cross-section and defines a rectangular longitudinal opening 117 along its length. A pair of flanges 112 and 114 defines a pair of slots 116 to receive wall panels.

Figure 7:
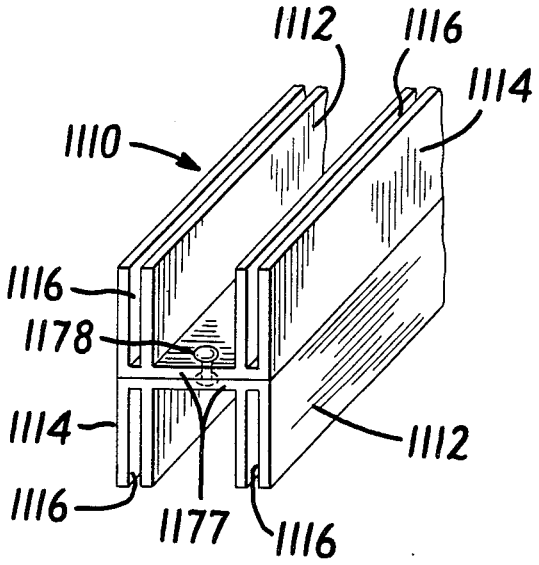
FIG. 7 is a fragmentary perspective view of yet another embodiment of the present invention in which the flanges are attached to a planar central portion or web.

In FIG. 7, a further embodiment of the present invention is illustrated in which the tubular portion 15 has been completely eliminated. In this embodiment, a pair of flanges 1112 and 1114 is attached directly to a planar central portion or web 1177 which performs the load bearing function of this single beam 1110. Two of these single beams 1110 can be bolted or otherwise connected together along their length with a bolt 1178, or other suitable connector, with their planar portions 1177 adjacent each other, forming a double beam similar in use to the double beam illustrated in FIG. 2.

While in FIGS. 6 and 7, single beams with only one pair of flanges are shown, it will be recognized that additional pairs of the slotted flanges can be attached in these embodiments as well.

Figure 8:
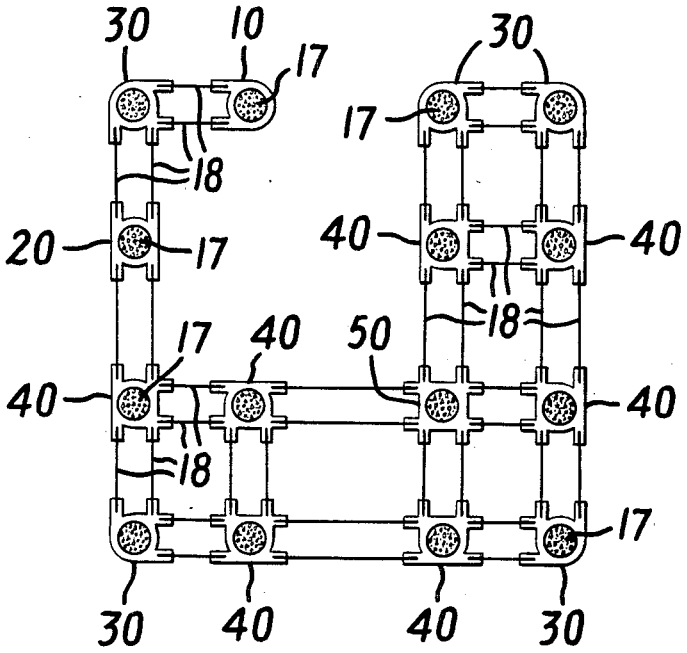
FIG. 8 is a schematic diagram showing one possible way of interconnecting wall panels in a building with the structural members of the present invention.

FIG. 8 illustrates schematically how wall panels 18 interconnect with each of the beams of the present invention to form an inexpensive building constructed without the use of skilled labor. A single beam 10 is shown ending a wall. Angle beams 30 define corners, a double beam 20 locates coplanar wall panels, "T" beams 40 retain interior panels, perpendicular to coplanar exterior walls, and a cross beam 50 retains panels of intersecting walls. The openings 17 of the beams are shown filled with concrete, sand, soil or a locally available and inexpensive fill.

Figure 9:
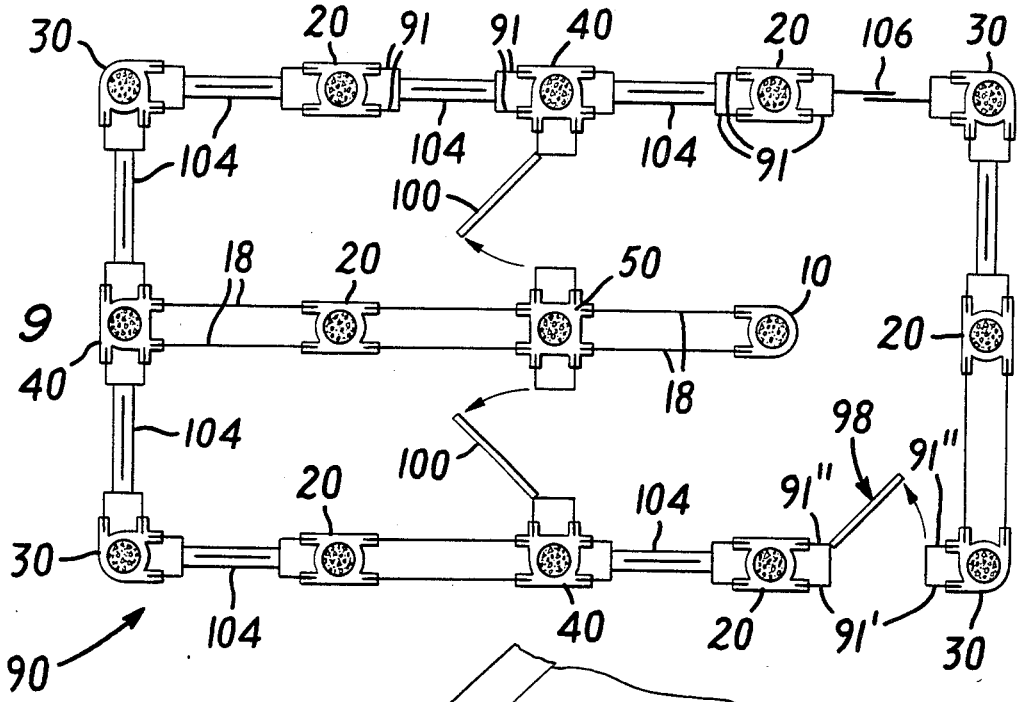
FIG. 9 is a schematic illustration of an exemplary layout or floor plan employing the structural members of FIGS. 1 to 5.
Figure 10:
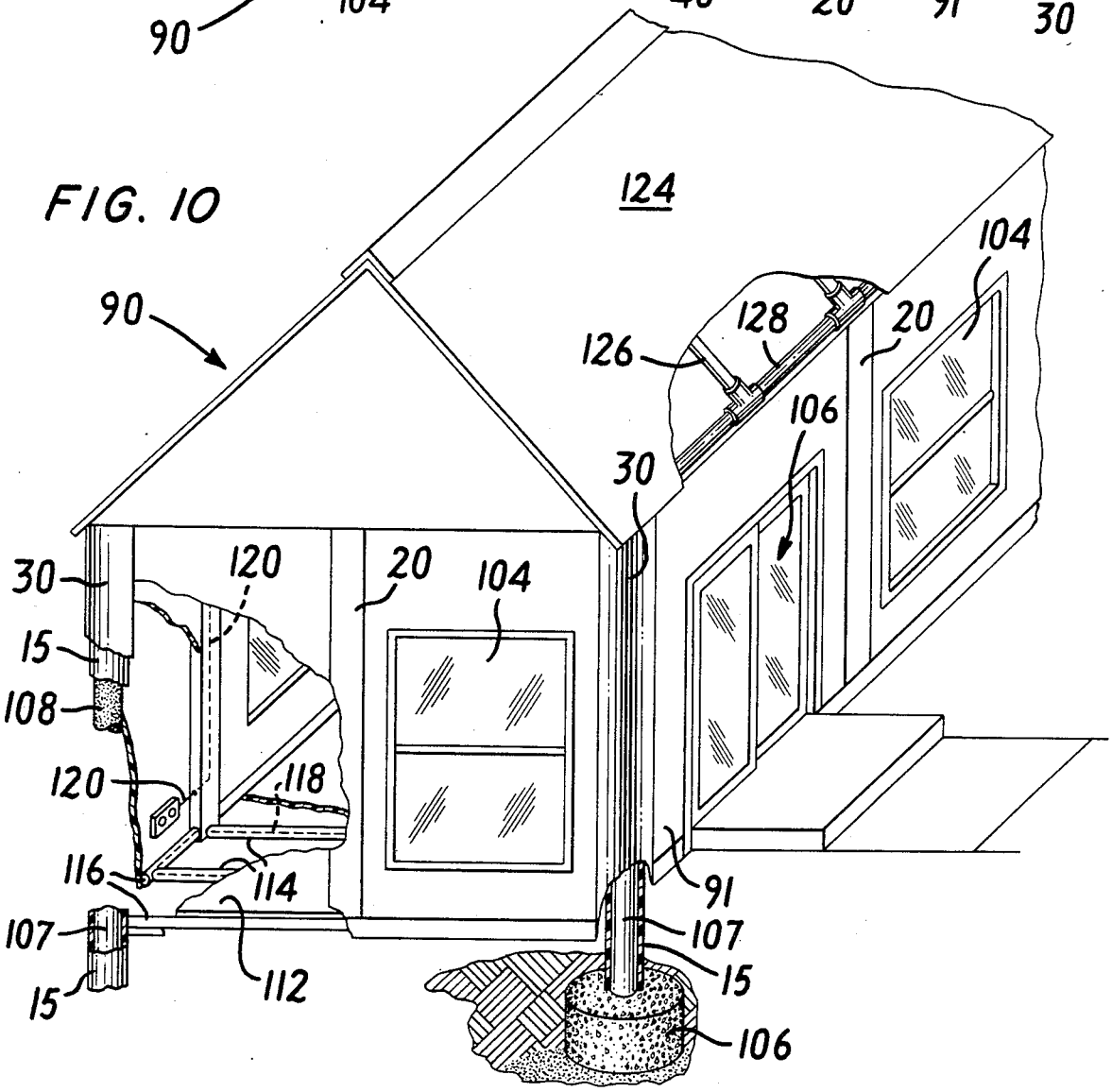
FIG. 10 is a fragmentary perspective view of a building showing a floor heating system, a roof, and having prefabricated doors and windows.

FIG. 9 illustrates the suitability of beams of the nature of those discussed above for use with certain prefabricated units. The windows and doors of this dwelling 90 may be prefabricated units for installation in associated partial wall segments 91, or the window or door along with their associated wall segments 91 can be a single prefabricated unit of standard size, adapted to fit directly into the panel retaining slots of beams at each side. For example, an exterior door 98 opens through an exterior wall. The entire door 98, frame and hardware can be prefabricated and wall segments 91′ and 91″ can be affixed thereto at an assembly site remote from the dwelling. The entire sub-assembly can be shipped as a single unit and connected with the beams at the time of erecting the building. Likewise, interior doors 100, windows 104, and sliding glass doors 106, for example, can be equipped to cooperate with beams of the kind described and illustrated.

The building 90 must employ a suitable foundation. Slab construction on a concrete foundation can be used. To avoid the skilled labor, expensive equipment and expensive steel rebar used for slab construction, the beams of the building 90 are particularly suited for the use of buried anchoring pods 106, known per se to support wood pilings 107. The pilings 107 or intermediate tublar members (not shown) are inserted in the tubular portions 15 of the beams and secured thereto by suitable means. Concrete poured in selected beams thus forms a concrete post or column 108 atop the piling 107.

A floor 112 of the building 90 is laid over PVC pipes 114 that connect with pipes 116 forming the lower frame or sill of the building. The floor support pipes 114 are affixed to the perimeter pipes by PVC welding cement or the like, or by other suitable connection means.

The interior of the building 88 is heated by heating system tubes 118 housed in the plastic floor-support pipes 114. Movement of hot water, for example, through the pipes 118 radiates heat through the floor 112 of the building, an arrangement especially suited to solar heating systems.

A significant advantage of a building constructed according to the system of the present invention is the ease with which electrical wiring and plumbing may be installed in the walls of the building. Both wiring 120 and plumbing (not shown) may be run through the tubular opening 17 of those beams that are left unfilled. These installations can be made at the site or can be prefabricated for later interconnection.

In constructing a roof 124 of the building 88, PVC or like pipes 126 are connected between similar pipes 128 interconnecting the upright beams 20, 30, 40, 50 about the tops of the exterior walls with a pipe or an angle beam according to the invention located proximate the roof peak.

Since the structural members 20, 30, 40, and 50 are made of plastic, simple cutting tools can be used to adjust the length of the members. PVC cement and fittings commonly used with plastic pipe are easily and quickly employed. More complex components such as the windows and doors are simply prefabricated and shipped to the site. All of this contributes to savings of time and expense and adds to the benefits of this invention, particularly where skilled labor and building materials are at a premium.

Turning to the embodiments of FIGS. 11 through 20, in FIG. 11 a plastic structural member 210, intended for use as an upright, has side flanges 212 and 213 integral with a central web 214 along its length. The member 210 may be extruded using the known Pultrusion fiberglass and resin material and process. A further pair of flanges 216 and 217 are integrally formed inward of the side flanges 212 and 213 to define slots 220 and 221 extending along the length of the member between each of the side flanges and an adjacent one of the inner flanges 216 and 217. At least at its uppermost end, the inner flanges 216 and 217 terminate short of the ends of the side flanges 212, 213, and the web 214. Measured from the web 214, the interior flanges 216 and 217 have a height H less than the height of the side flanges 212 and 213, similarly measured.

In FIG. 12 a base structural member 230, again of plastic such as the commercially available Pultrusion material and preferably extruded, has side flanges 232 and 233 integrally extruded with and extending along the length of a web 234. The base member 230 has a series of openings 235 formed along the length of one of the flanges 233. In one arrangement, the base member 230 may also include further inner, integral flanges 236 and 237 as illustrated in phantom outline in FIG. 12. In that case, the inner flange 237 adjacent to the side flange 233 has formed therein a series of openings 238 in alignment with the openings 235 in the side flange 233. The optional inner flanges 236 and 237 extend to a height H measured from the web 234 that is less than the height of the side flanges 233 and 232 similarly measured. In use, the base member 230 is provided for use at the exterior boundary of a building, the flange 232 facing outward, and the flange 233 facing the building interior. The openings 235, and the openings 238 if the optional flange 237 is included, receive elongate tubular members 240, spanning the interior of the building at generally floor level. Again the inner flanges 234 and 236 form, with the side flanges 230 and 232, a pair of slots 242 and 243 running the length of the member 230.

In FIG. 13, a similarly formed base member 250 includes two series of openings 255 in alignment in each of a pair of side flanges 252 and 253 that are integrally formed along each side of a central web 254. Optionally, the base member 250 may be provided with a pair of further inner flanges 256 and 257 of a shorter height H, defining slots 251 and 259. Each of the optional inner flanges 256 and 257, when provided, has an aligned series of openings 258 formed therein. The base member 250 of FIG. 213 is provided for use at floor level within the perimeter of a building and the aligned openings 255 and 258 permit the passage therethrough of the tubular members 240 at about floor level.

In FIG. 14, the structural plastic member 210 of FIG. 11 is shown in combination with a plank or board 260 of standard lumber dimensions and serving as a closure member. Openings into the building at doorways and the like employ the structural member 210 in association with the plank 260 to form door frames, the plank 260 being used to frame the doorway and mask the interior of the extruded member. The shorter height H of the inner flanges 216 and 217 provides recessed elongate edges 223 and 224. These edges and edge portions of interiorly facing surfaces 227 and 228 of the side flanges 212 and 213 form means for receiving the plank 260. Conventional fasteners 229 such as simple nails or screws can be employed to secure the plank 260 in place. In the base members of FIGS. 12 and 13, when inner flanges 236, 237, and 256, 257 are included, their lower height H permits location of a member between interior surfaces of the side flanges at the elongate upper edges of the inner flanges to form door saddles, for example, at openings into the structure and between interior rooms.

FIGS. 15 and 16 illustrate the cooperation of the upright structural member 210 with panels 261 and 262 having vertical edges received in the slots 220 and 221. The panels 261 and 262 form opposite surfaces of a wall. At its upper end, the member 210 defines means for receiving an end portion of a spanning element 264 that runs from one of the structural members 210 to a further such element, (not shown in FIGS. 15 and 16), atop the panels 261 and 262. It is the edges 265 and 266 of the shorter ends of the inner flanges 216 and 217 and the ends of the interiorly facing surfaces 227 and 228 of the side flanges 212 and 213 that define the means for receiving the spanning element 264. Once more, conventional fasteners 229 mav secure the spanning element in place. Alternatively, the connecting web 234 may be shortened at the location 234*a* to permit a longer spanning element (not shown) to pass through the upper end of the structural member 210 and form a continuous upper boundary for a wall section.

Figure 17:
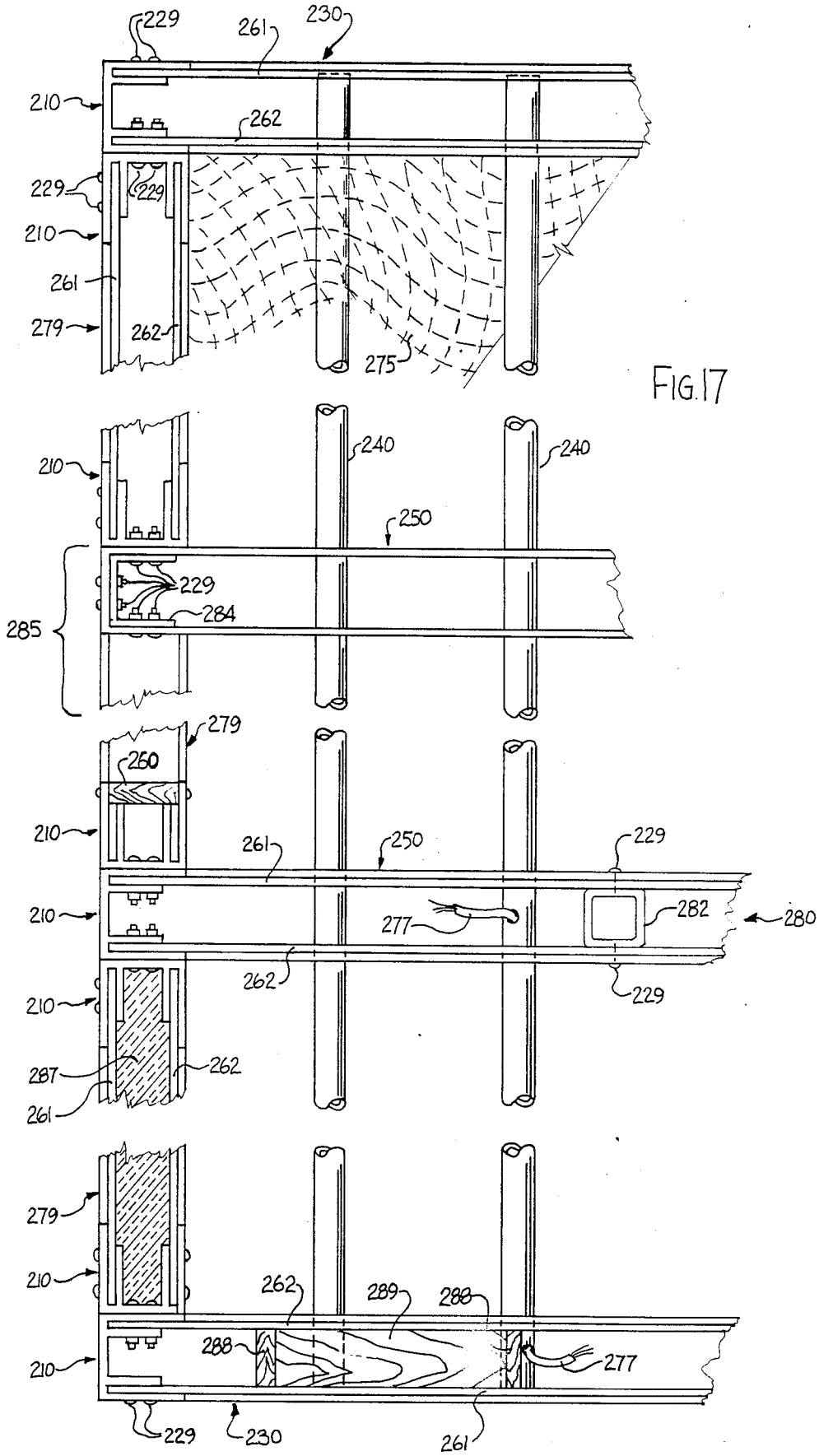
FIG. 17 is a fragmentary top plan view of a partially assembled building employing extruded base and upright members of the kind illustrated in FIGS. 11–16.

In FIG. 17 the interrelationship of the elements illustrated in FIGS. 11–16 can be seen. Viewed from above, a partially completed building employs base members 230 at opposite ends of the building. Tubular members 240, which may be lengths of conventional PVC pipe, span the interior at about floor level. Woven over and under the spanning tubular members, a wire mesh 275 fills the interior area of the ground level of the building between the base members for use in forming a poured concrete floor as will be explained in further detail below.

The tubular members 240 conveniently permit routing of the building services, for example as illustrated by the electrical wiring 277. Likewise, plumbing can be routed through the tubular members and those not used for wiring and plumbing can conveniently direct heating fluid from a heating plant (not shown) throughout the flooring. Where other than a concrete floor is to be provided, the tubular members 240 can support wood flooring. Depending upon the strength required of these members in such cases, they may be metal pipes or some material other than the preferred plastic. Intermediate the base members 230, a further pair of base members 250, like that of FIG. 13 extend across the building. The tubular members 240 proceed, uninterrupted, through the base members 250 by means of the aligned series of openings 258, as shown in FIG. 13. A further series of base members 279 extends along the perimeter of the building parallel to the tubular members 240. These may be like the members 230 illustrated in FIG. 12 or they may be entirely devoid of the openings 235. Upright members 210 like those of FIG. 11 appear at various locations throughout the building. These retain wall panels 261 and 262 that form opposite surfaces of the walls of the building. At a interior wall 280, a tubular extruded upright 282 may provide structural support hidden between the panels 261 and 262. Throughout the walls conventional fasteners 229 and bolts 283 secure together adjoining elements, and may be used in addition to commercial resin bonding adhesives or solvents. Connecting brackets, angles, and the like, such as the bracket 284 may be used where necessary. To one side of a doorway 285 a plank 260 can be seen forming a part of the door frame and closing off the interior of its associated upright member 210. If desired, at exterior walls, the voids between the panels 261 and 262 can be filled with insulation as shown at 287. Window or door structure can be secured within the panels 261 and 262, by providing upright frame members 288 and lateral frame members 289, which will be better understood with respect to FIG. 20, to be described below.

Figure 18:
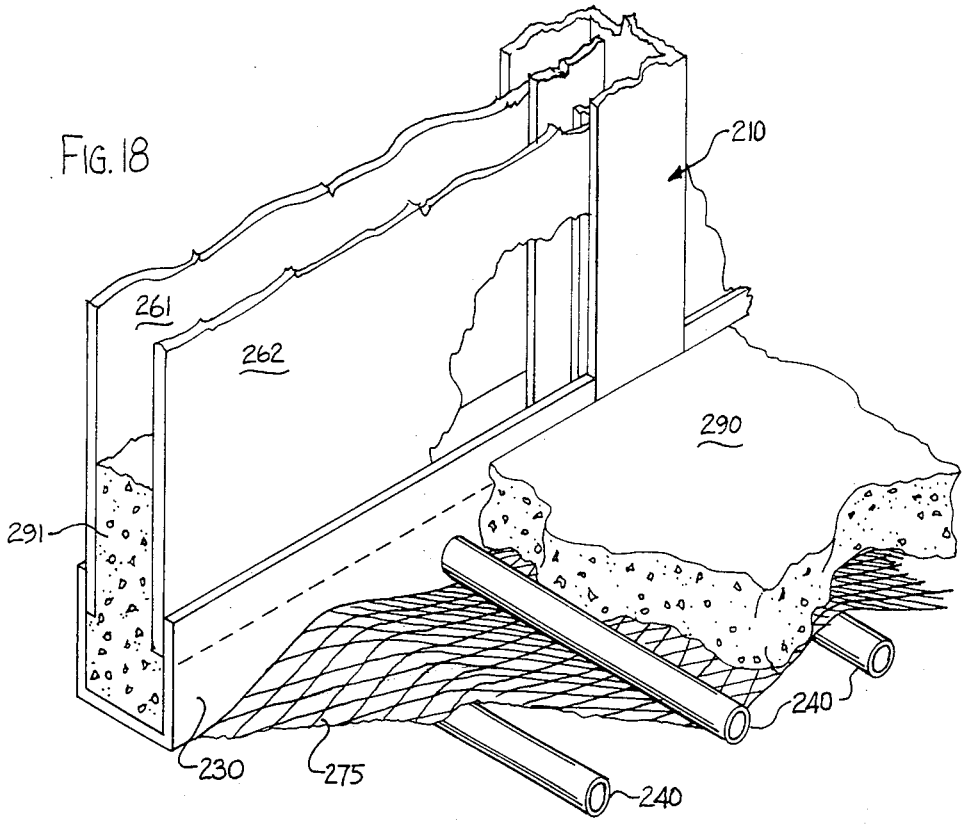
FIG. 18 is a fragmentary perspective view of a building wall, poured concrete flooring, and partial concrete wall fill employing members like those of FIGS. 11–16.

In FIG. 18, the relationship of poured cement flooring to the wire mesh or web is illustrated. The mesh 275 is seen woven over the first of the tubular members 240 and under the next. Poured concrete flooring 290 covers the wire mesh 275 and the members 240. A considerable saving in the amount of concrete required is realized by virtue of the wire meshes' prevention of the poured concrete entirely filling the volume from the upper floor surface to ground level. Between the panels 262 and 261 concrete fill 291 may be poured, partially as shown, or entirely to the top of the void between the panels. At doorways the exposed base member may be filled to the top with concrete if it is not closed by plank 260 or other member forming a saddle.

Figure 19:
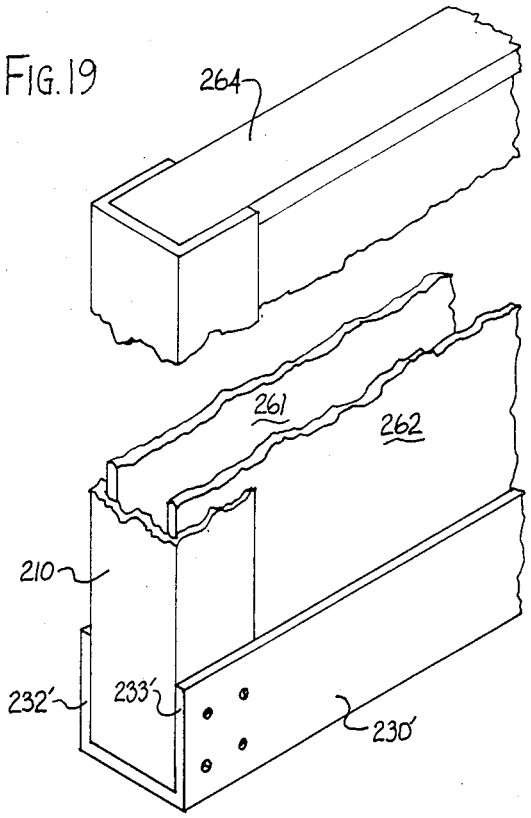
FIG. 19 is a fragmentary perspective view of a further wall embodiment in which base members are dimensioned to receive uprights.

In FIG. 19 an alternative arrangement of the upright members 210 and base members 230′ is shown. Whereas in the previous members the width of the base members and of the upright members have been equal, requiring cutting for interfitting, the base member 230′ of FIG. 19 is sufficiently wider than the upright member 210 to receive the upright member snugly between its side flanges 232 and 233. In this arrangement a slight opening occurs between the panels 261 and 262, and the side flanges 232′ and 233′, respectively. This may be closed by caulk 297 as shown.

Figure 20:
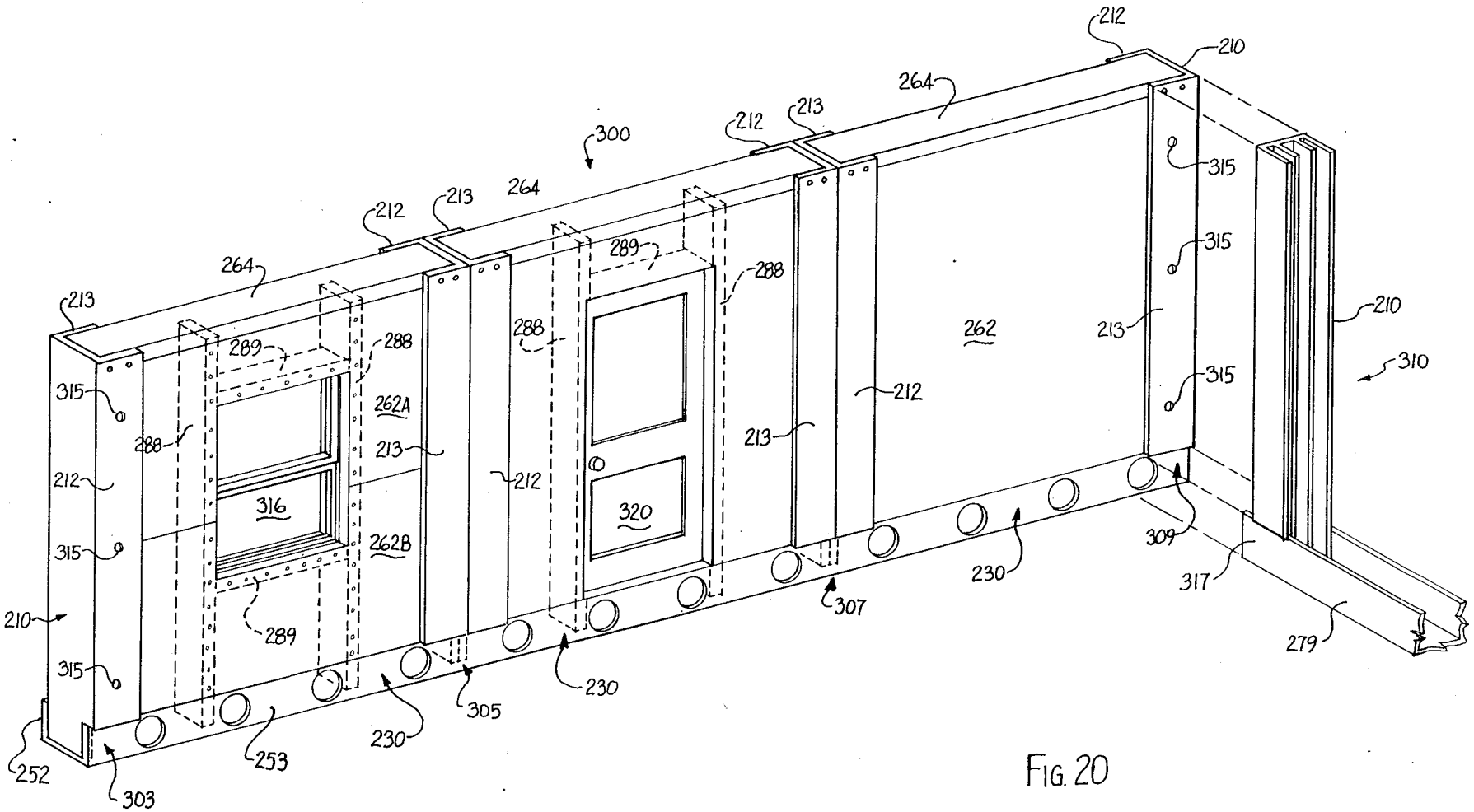
FIG. 20 is a perspective view of a preconstructed wall assembly suitable for shipment to and erection at a construction site.

FIG. 20 illustrates a prefabricated wall section 300 that is preassembled prior to shipment. Preferably the section 300 is of appropriate length to fit a shipping container and is erected at the construction site. In this wall section, a slight alteration represents a further alternative over the construction described above. The extruded upright members 210 are the same width as the base member 230. On the exterior side of the section the side flanges 213 and 212 fit inside the side flange 252 of the base member. The exterior side, not shown, will appear similar to FIG. 19, then. On the interior, the extruded upright members 210 are cut away to accommodate the side flange 253 at the locations 303, 305, 307 and 309. The discontinuity between the side flanges 212 and 213 where they meet the side flange 253 in the locations 303, 305, 307 and 309 on the interior side of the wall can be masked by pouring the concrete flooring to the full height of the side flange 253 of the base member 230.

The upright members 210 at each end of the wall section 300 have openings 315 spaced along their length for alignment with similar openings (not shown) in the web portion of an adjoining wall section 310 which is to be attached thereto. The openings 315 are to receive bolts for bolting together the adjoining wall sections. Preferably the abutting faces of the end upright members of the adjoining wall sections are coated with suitable bonding agent and the two end members are bolted together. For this purpose, the panels 261 and 262 are slid into place after joining of the wall sections and the spanning element 264 is then inserted. If the entire wall section 300 is shipped complete, the panels and spanning elements can be held temporarily in place for easy removal to permit access to the end upright interiors for bolting purpose. The panels can, of course, be slotted to permit their edges to slip past the bolts or the spacing of the uprights can be such that the panels are received in their slots only to the location of the bolts.

The adjoining wall section 310 accommodates the slight recessing of the base member from the upright member at the building corner. Its end upright member 210 is situated slightly inward of its end base member 279, as shown. This leaves a slight projection 317 fitting the recess at the location 309.

Upright studs within the panels 261 and 262 form the upright frame members 288 and cooperate with horizontal frame members 289 to frame a window 316. A further pair of the upright frame members 288 and another of the horizontal frame members 289 cooperate to frame a door 320.

In buildings formed using the elements of FIGS. 11–20, prefabricated roofing can easily be affixed by nailing or otherwise fastening the prefabricated roof to the wooden spanning elements 264. Preferably the upright members 210 are spaced 8 or 12 feet apart. The upright members are about 8 feet high measured from the top of the base flanges. The base and upright members are approximately 6 inches wide and 6 inches high from web bottom to side flange top. The slots between side inner flanges can be of an appropriate width to receive a standard plywood panel, about ½ inch. Two 8'×4' plywood panels can be inserted to form one wall panel 261 or 262 or a one-piece panel may be made and inserted. The size of the series of openings in flanges of the base members are standard PVC pipe O.D. sizes when such pipes are used as the tubular member 240.

Various further modifications in the particular beams, combinations, and building methods of the foregoing invention may be made without departing from the spirit and scope of the invention as set forth in the appended claims.

I claim:

1. An elongate thermoplastic structural member for use in building construction including side flanges spaced laterally apart, extending longitudinally of the member, a connecting web portion extending longitudinally of the member between said flanges and integral with the flanges, a further pair of flanges integral with the connecting web portion, laterally interior of the side flanges and extending longitudinally of the structural member proximate the side flanges and the side flanges defining slots for receiving edges of panels forming opposite surfaces of a building wall, the further flanges having a height measured from the connecting web portion less than the height of the side flanges so measured, the elongate edges of the further flanges and interiorly facing surfaces of the side flanges between the location of said further flange edges and of the side flanges defining means for receiving a closure member located between the side flanges at the longitudinal ends of the further flanges to close the interior of the structural member; at at least one end of the structural member, said pair of further flanges terminate short of the ends of the side flanges, the ends of the pair or further flanges and interiorly facing surfaces of the side flanges defining means for receiving a portion of a spanning element extending from the structural member to a like structural member.

2. An elongate thermoplastic structural member for use in building construction including side flanges spaced laterally apart, extending longitudinally of the member, a connecting web portion extending longitudinally of the member between said flanges and integral with the flanges, a further pair of flanges integral with the connecting web portion, laterally inward of the side flanges and extending longitudinally of the structural member proximate the side flanges, the further flanges and the side flanges defining slots for receiving edges of panels forming opposite surfaces of a building wall, said pair of further flanges terminating short of the ends of the side flanges at at least one end of the structural member, ends of of the pair of further flanges and interiorly facing surfaces of the side flanges between the location of the further flanges and the ends of the side flanges defining means for receiving a portion of a spanning element extending from the structural member to a like structural member.

3. The structural member of claim 2 wherein the web portion extends beyond the ends of the further flanges to the ends of the side flanges and the ends of the further flanges and the interior surfaces of the web portion and side flanges form the means for receiving an end portion of the spanning element.

4. A building system having a combination of structural members for use in the construction of a building including a plurality of elongate thermoplastic structural base members and a plurality of additional members adapted for use as uprights extending vertically from the base members, each of said base and additional members including side flanges spaced laterally apart, extending longitudinally of the member and located for proximity with two wall panels forming opposite faces of a wall of the building, at least two of the base members having a series of longitudinally spaced openings through one of the side flanges and defining means for receiving ends of hollow tubular members spanning the building at substantially floor level, at least said additional members having pairs of further flanges integral with the connecting web portion, laterally inward of the side flanges, extending longitudinally of the additional members and defining with the side flanges slots for receiving edges of at least a number of the wall panels forming wall surfaces.

5. The building system according to claim 4 wherein at least one of said base members is a central base member for location interiorly of the sides of building and includes a series of longitudinally spaced openings through both of the side flanges thereof, the series of openings in each of the side flanges thereof being aligned to receive the tubular members entirely through the central base member transversely.

6. The building system according to claim 4 wherein said base members include a pair of the further flanges integral with the connecting web portion, laterally interior of the side flanges thereof, extending longitudinally of the base member and defining with the side flanges slots for receiving lower edges of a pair of wall panels forming wall surfaces.

7. The building system according to claim 6 wherein the pair of further flanges on at least one of the structural members extends to a height less than the side web portion, ends of the less high further flanges and interior surfaces of the side flanges forming means for receiving an element for closing the interior of the structural member.

8. The building system of claim 6 wherein the pair of further flanges of the additional members adapted for use as uprights terminate at at least one end of the member short of the ends of the side flanges to define above the ends of the pair of further flanges and between interior surfaces of the side flanges means for receiving a portion of a spanning element extending from the upright additional element to a like upright additional element to form the upper boundary of a wall.

9. The building system according to claim 6 wherein at least two of the additional members and one of the base members are joined into a unified transportable wall assembly with first and second panels having edges received in the slots formed between the side flanges and the further flanges.

10. The building system of claim 4 connected to form a building having spaced base members with side flanges having said longitudinally spaced openings facing across the interior of the building proximate a floor level, hollow tubular members extending from one of the spaced base members to the other with ends received in the openings, said additional members connected to the base members in upright position, panels forming interior and exterior surfaces of the building exterior walls having edge portions thereof received in the slots between the side flanges and further flanges of the upright additional members.

11. The building system connected to form a building according to claim 9 wherein the panels define a space therebetween, said space being at least partly filled with cementitious material.

12. The building system connected to form a building according to claim 9 wherein the elongate tubular members house at least a part of the buildings services.

13. The building system connected to form a building according to claim 9 wherein at least one of the structural members has side and further flanges directed towards an adjoining opening through a building wall, the further flanges having a height less than the side flanges measured from the web portion thereof and a closure member received between the side flanges at the ends of the further flanges to at least partly frame the opening through the wall and mask the interior of the structural member.

14. The building system connected to form a building according to claim 9 wherein the additional members in upright position have uppermost ends of the further flanges thereof ending short of the uppermost ends of the said flanges, a spanning element extending from the upright to another like upright above panels supported therebetween and having a portion thereof received between interior surfaces of the ends of the side flanges and atop the ends of the further flanges.

15. The building,system connected to form a building according to claim 9 further comprising a poured cementitious floor covering the elongate tubular members.

16. The building system connected to form a building according to claim 9 further comprising a mesh woven over and under the tubular members and over which the material of the cementitious floor is poured.

* * * * *

UNITED STATES PATENT AND TRADEMARK OFFICE

CERTIFICATE OF CORRECTION

PATENT NO. : 4,612,744

DATED : September 23, 1986

INVENTOR(S) : Jack E. Shamash

It is certified that error appears in the above-identified patent and that said Letters Patent is hereby corrected as shown below:

Col. 7, line 10, "tublar" should be --tubular--.
Col. 9, line 1, "mav" should be --may--.
Col. 11, line 41, "or" should read --of--;
line 59, "of of" should be --of--.
Col. 12, line 25, before "building" insert --a--.
Col. 13, line 5, "claim 9" should read --claim 10--;
line 10, "claim 9" should read --claim 10--;
line 13, "claim 9" should read --claim 10--.
Col. 14, line 4, "claim 9" should read --claim 10--;
line 13, "claim 9" should read --claim 10--;
line 17, "claim 9" should read --claim 15--.

Signed and Sealed this

Twenty-first Day of April, 1987

*Attest:*

DONALD J. QUIGG

*Attesting Officer*

*Commissioner of Patents and Trademarks*